US007552755B2

(12) United States Patent
Lin

(10) Patent No.: US 7,552,755 B2
(45) Date of Patent: Jun. 30, 2009

(54) MOVABLE SEAT OF A VERTICAL CURTAIN

(76) Inventor: Ya-Ying Lin, No. 18, Taishan 2nd St., Fuchuan Li, Chiayi City (TW)

( * ) Notice: Subject to any disclaimer, the term of this patent is extended or adjusted under 35 U.S.C. 154(b) by 246 days.

(21) Appl. No.: 11/563,887

(22) Filed: Nov. 28, 2006

(65) Prior Publication Data

US 2008/0121351 A1 May 29, 2008

(51) Int. Cl.
*E06B 9/36* (2006.01)

(52) U.S. Cl. ..... 160/168.1 V; 160/178.1 V

(58) Field of Classification Search ..... 160/173 V, 160/168.1 V, 177 V, 176.1 V, 178.1 V, 901
See application file for complete search history.

(56) References Cited

U.S. PATENT DOCUMENTS 4,628,981 A * 12/1986 Ciriaci et al. ..... 160/176.1 V
4,799,527 A * 1/1989 Villoch et al. ..... 160/168.1 V
4,834,163 A * 5/1989 Dickstein ..... 160/176.1 R
5,146,970 A * 9/1992 Danieli ..... 160/173 V
6,408,924 B1 * 6/2002 Anderson et al. ..... 160/168.1 V
6,866,078 B1 * 3/2005 Lin ..... 160/177 V

* cited by examiner

*Primary Examiner*—Blair M. Johnson
(74) *Attorney, Agent, or Firm*—Alan Kamrath; Kamrath & Associates PA

(57) ABSTRACT

A movable seat of a vertical curtain is disposed in an upper rail and is provided for suspending vertical curtain blades. One side of the movable seat is defined with an open slot for engaging with a distance piece, and a hook hole is formed in a top end of the movable seat. A connecting post is locked in the hook hole for connecting to a scissor type distance piece. By such arrangements, plural movable seats can be moved interactively by choosing the distance piece or the scissor type distance piece, thus controlling the angle of the vertical curtain blades.

4 Claims, 9 Drawing Sheets

MOVABLE SEAT OF A VERTICAL CURTAIN

BACKGROUND OF THE INVENTION

1. Field of the Invention

The present invention relates to a movable seat of a vertical curtain which is disposed in an upper rail and which is provided for suspending vertical curtain blades. One side of the movable seat is defined with an open slot for engaging with a distance piece, and a hook hole is formed in a top end of the movable seat. A connecting post is locked in the hook hole for connecting to a scissor type distance piece. Thus, plural movable seats move interactively, so as to control the angle of the vertical curtain blades. Thereby, the movable seat of the present invention can meet with the requirements of different structures with interactive moving effects.

2. Description of the Prior Art

A conventional vertical curtain generally comprises a plurality of vertical curtain blades suspended by movable seats disposed in an upper rail, such as the structure described in U.S. Pat. No. 6,866,078. However, the conventional vertical curtain cannot simplify the manufacturing process and the molds. A turning rod is inserted into a turning seat of each of the movable seats. In addition to that, there must be a linkage between the movable seats, such that the vertical curtain blades can be opened or closed by pulling an adjusting rod. The main problem is the arrangements of distance pieces and scissor type distance pieces (the distance pieces are strip-shaped and can be passed through to each other, so the distances between the curtain blades are adjustable; and the scissor type distance pieces use the adjustable scissor type posts to change the distances of the curtain blades). Thereby, the shapes of the cross sections of the upper rail are different, such that the movable seats can be moved in the upper rail interactively.

Since the connecting structures of the distance piece and the scissor type distance piece to the movable seat are different (one is assembled to a side of the movable seat, and the other is assembled to a top end of the movable seat), the conventional vertical curtain is high cost (two kinds of movable seats must be manufactured to meet the users' requirement).

The present invention has arisen to mitigate and/or obviate the afore-described disadvantages.

SUMMARY OF THE INVENTION

The primary objective of the present invention is to provide a movable seat of a vertical curtain which is disposed in an upper rail and which is provided for suspending vertical curtain blades. One side of the movable seat is defined with an open slot, and a hook hole is formed in a top end of the movable seat for insertion of a connecting post.

Since one side of the movable seat of the present invention is defined with an open slot. A distance piece can be disposed between two movable seats, such that the movable seats can be moved interactively. After the plural movable seats are disposed in the upper rail, each movable seat can position a vertical curtain blade. Furthermore, with regards to a scissor type distance piece, the scissor type distance piece can be passed through the hook hole of the top end of the movable seat by the connecting post directly. Thus, the movable seat is applicable to the distance piece and the scissor type distance piece, so as to reduce the cost.

The present invention will become more obvious from the following description when taken in connection with the accompanying drawings, which show, for purpose of illustration only, the preferred embodiments in accordance with the present invention.

DETAILED DESCRIPTION OF THE PREFERRED EMBODIMENTS

Figure 1:
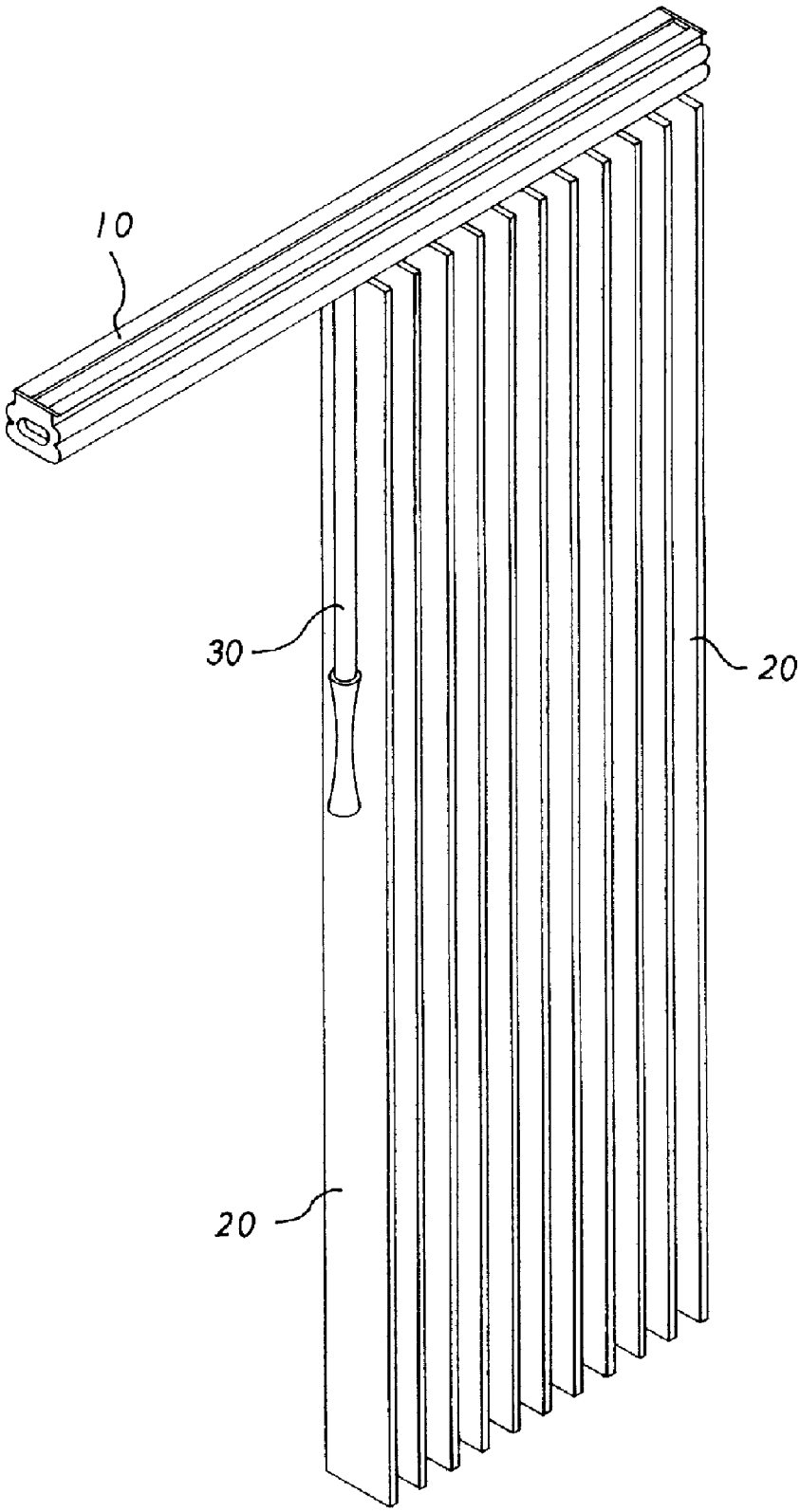
FIG. 1 is a perspective view of a vertical curtain in accordance with the present invention.
Figure 2:
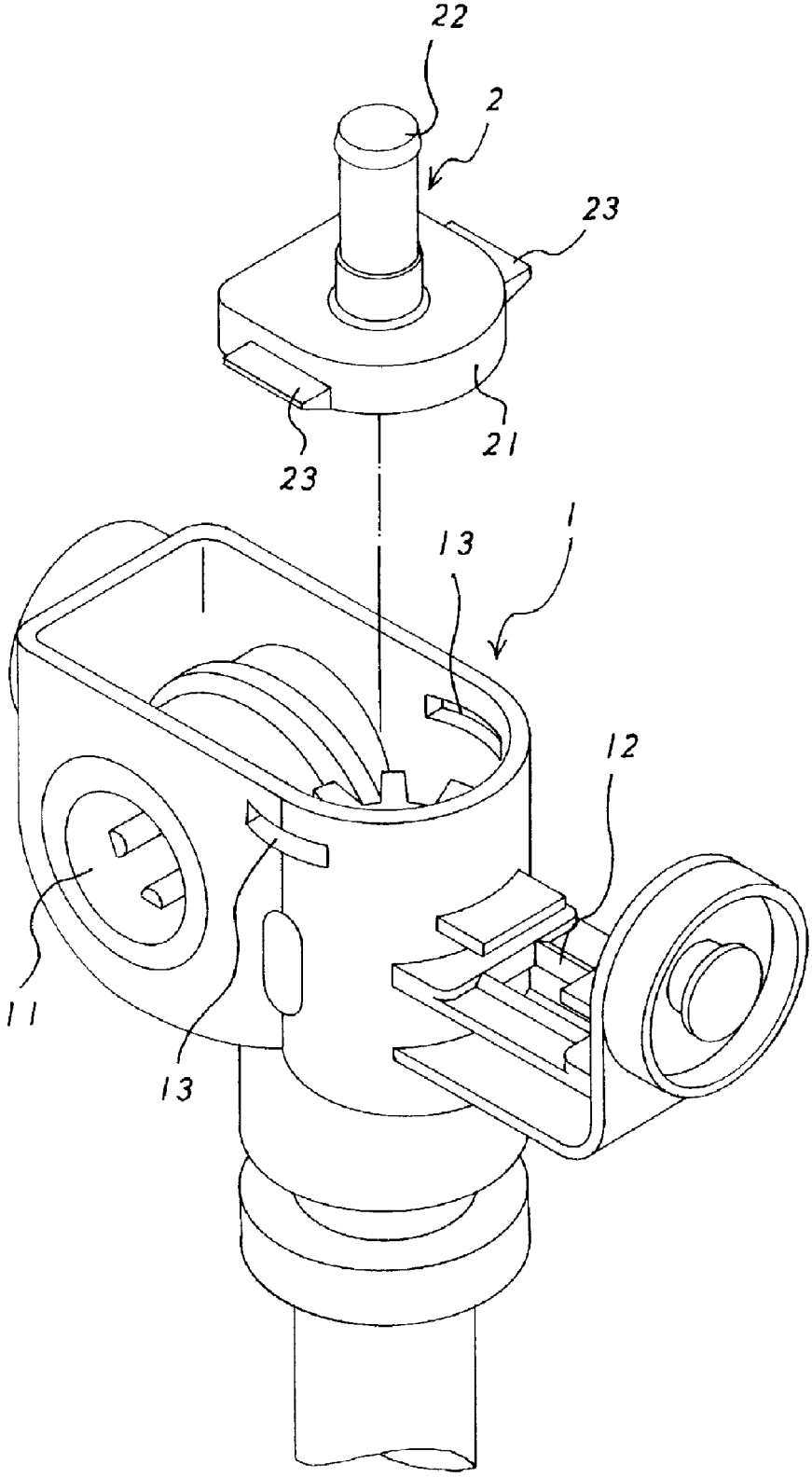
FIG. 2 is an exploded, perspective view of a movable seat in accordance with the present invention.

Referring to FIGS. 1 and 2, a movable seat 1 of a vertical curtain in accordance with the present invention is disposed in an upper rail 10 and is provided for suspending the vertical curtain blades 20.

Figure 3:
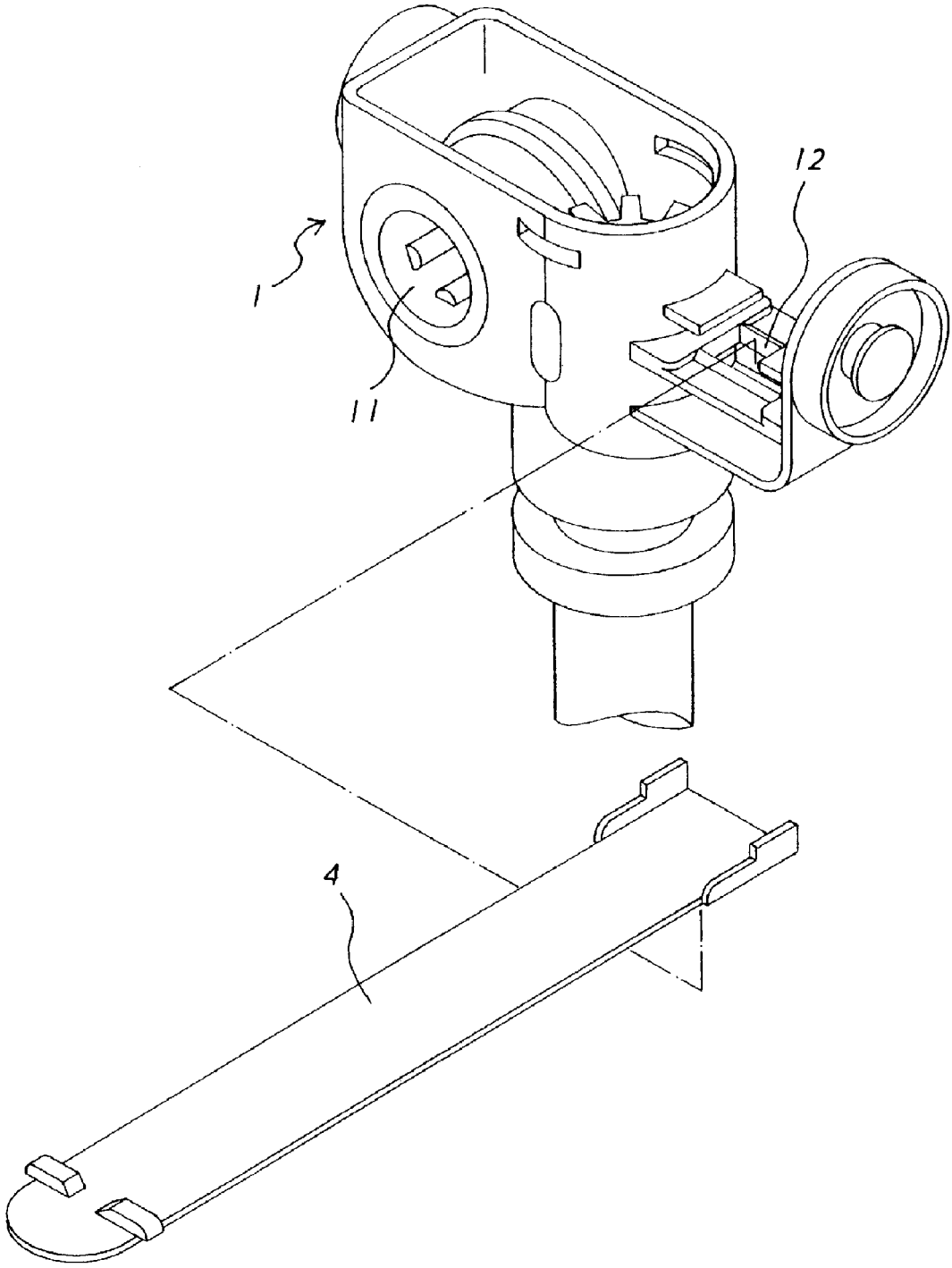
FIG. 3 is an exploded, perspective view of the movable seat and a distance piece in accordance with the present invention.

A turning seat 11 is disposed in the movable seat 1 for insertion of a turning rod 3. One side of the movable seat 1 is defined with an open slot 12 for engaging with a distance piece 4. A hook hole 13 is formed in a top end of the movable seat 1 (as shown in FIG. 3).

A pivoting pole 22 is protruded out of a base 21 of a connecting post 2. A locking hook 23 located correspondingly to the hook hole 13 is disposed on a side of the base 21.

Figure 4:
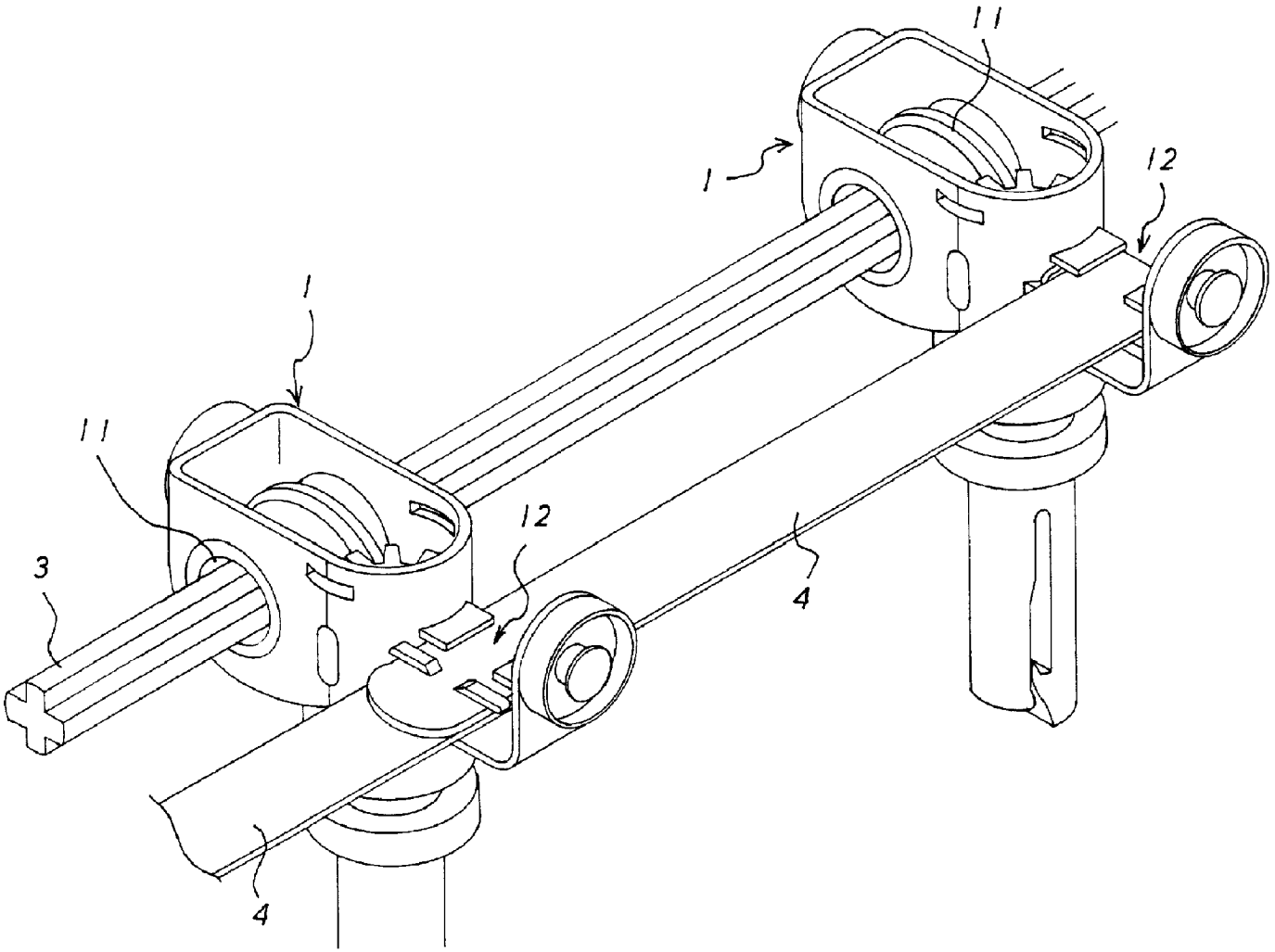
FIG. 4 is a perspective view showing the interactive moving of the movable seats via the distance piece.

By such arrangements, the turning seats 11 of plural movable seats 1 are provided for insertion of the turning rods 3, and the open slot 12 of each movable seat 1 is provided for engaging with the corresponding distance piece 4. Since front and rear ends of each distance piece 4 can be connected to each other, the movable seats 1 have the characteristic of moving interactively (as shown in FIG. 4). Thereby, after the movable seats 1 are disposed in the upper rail 10, the respective movable seat 1 is provided for suspending the vertical curtain blade 20, thus finishing the assembly of the vertical curtain.

Figure 5:
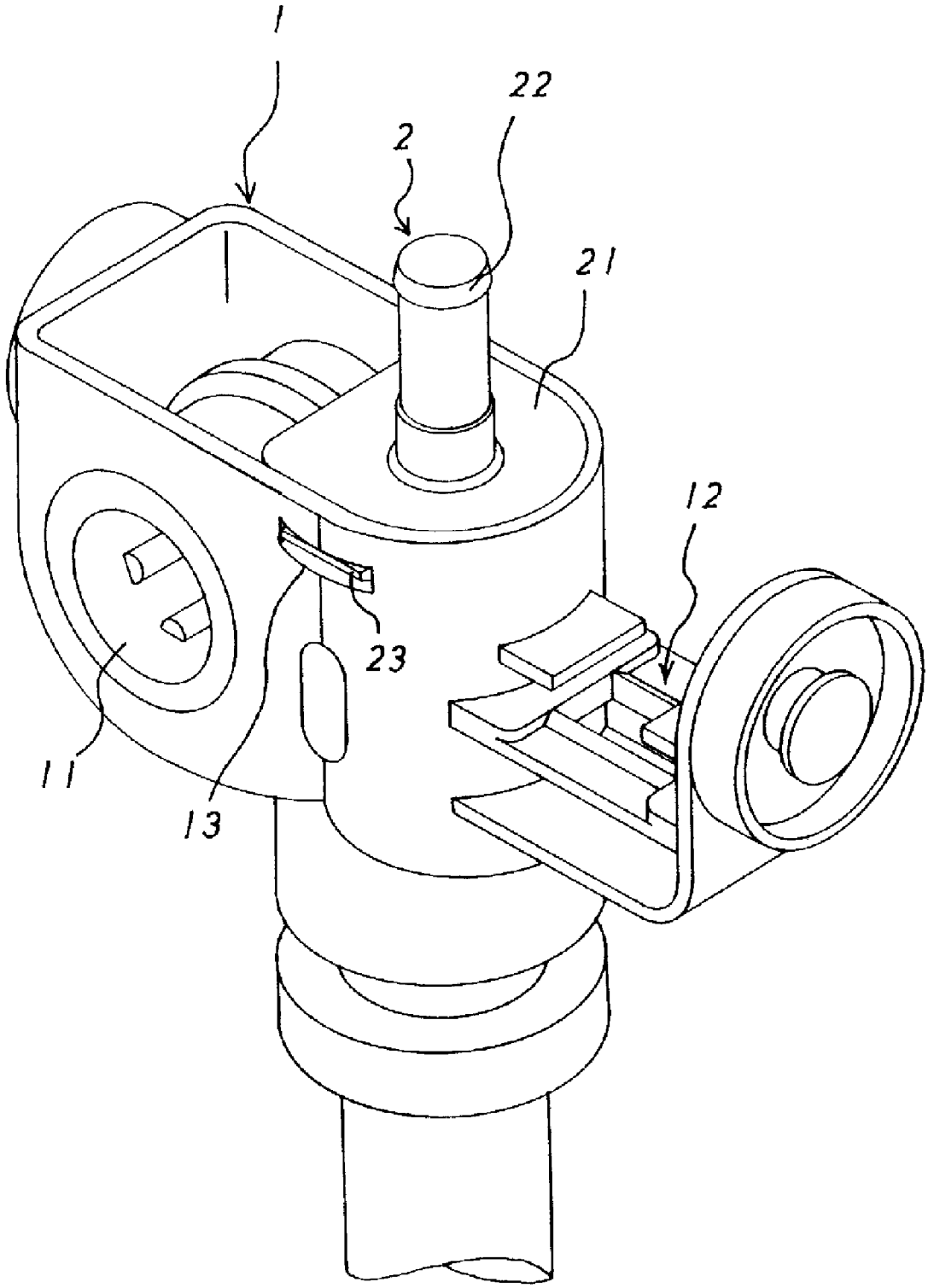
FIG. 5 is a perspective view of the movable seat connected to a connecting post.
Figure 6:
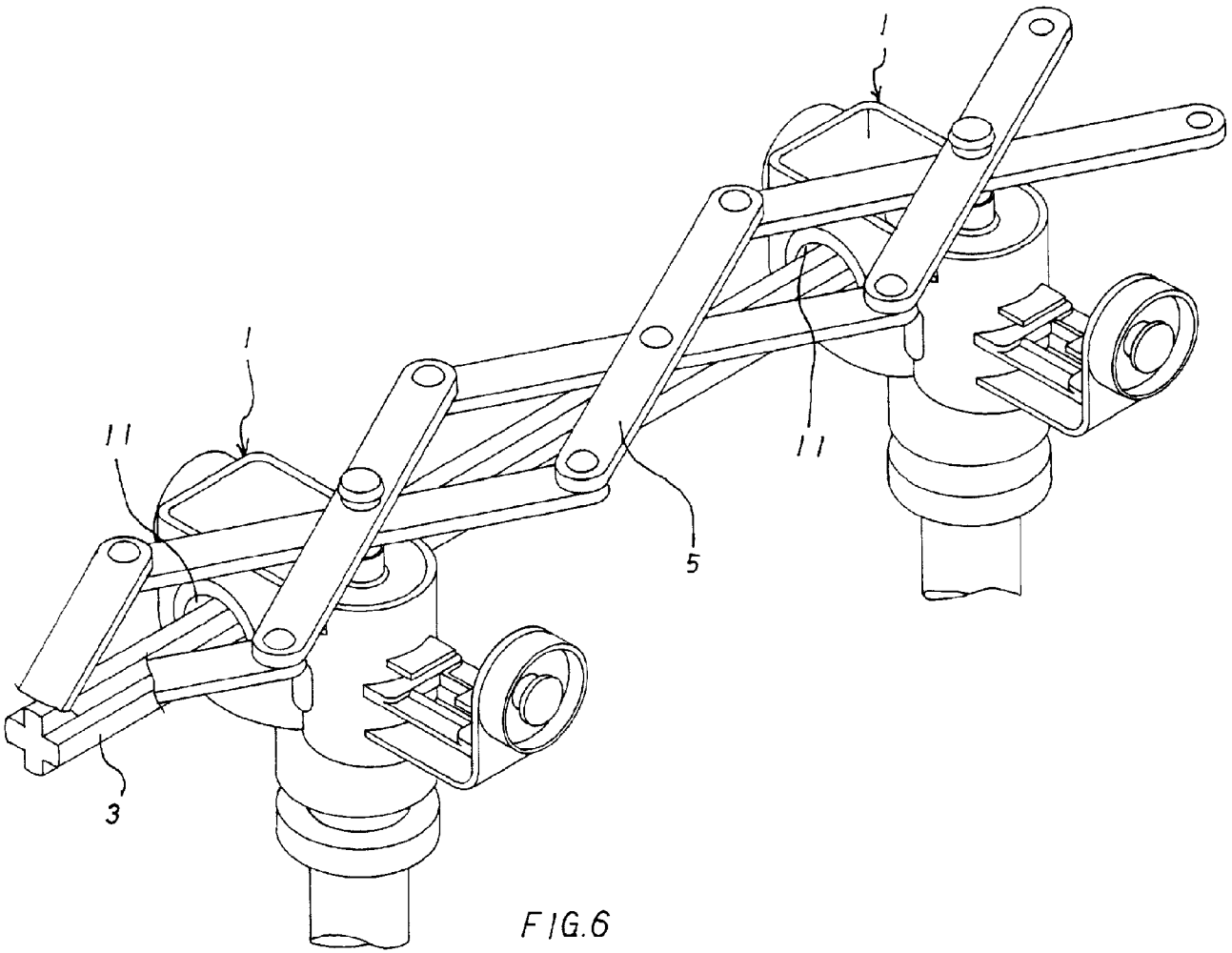
FIG. 6 is a perspective view showing the interactive moving of the movable seats via the scissor type distance pieces.

Therefore, in operation, an adjusting rod 30 can open or close the vertical curtain blades 20, or the angle of the vertical curtain blades 20 can be adjusted by rotating the turning rod 3 with the adjusting rod 30. each movable seat 1 is firstly connected to the connecting post 2 (as shown in FIG. 5), Next the connecting post 2 is connected to the scissor type distance pieces 5. Thus, the movable seats 1 can be moved interactively (as shown in FIG. 6). Thereby, the distance pieces 4 and the scissor type distance pieces 5 can be disposed on the movable seat 1, and one kind of movable seat 1 can be manufactured to meet with the requirements of different structures with interactive moving effects, so as to reduce the cost.

Figure 7:
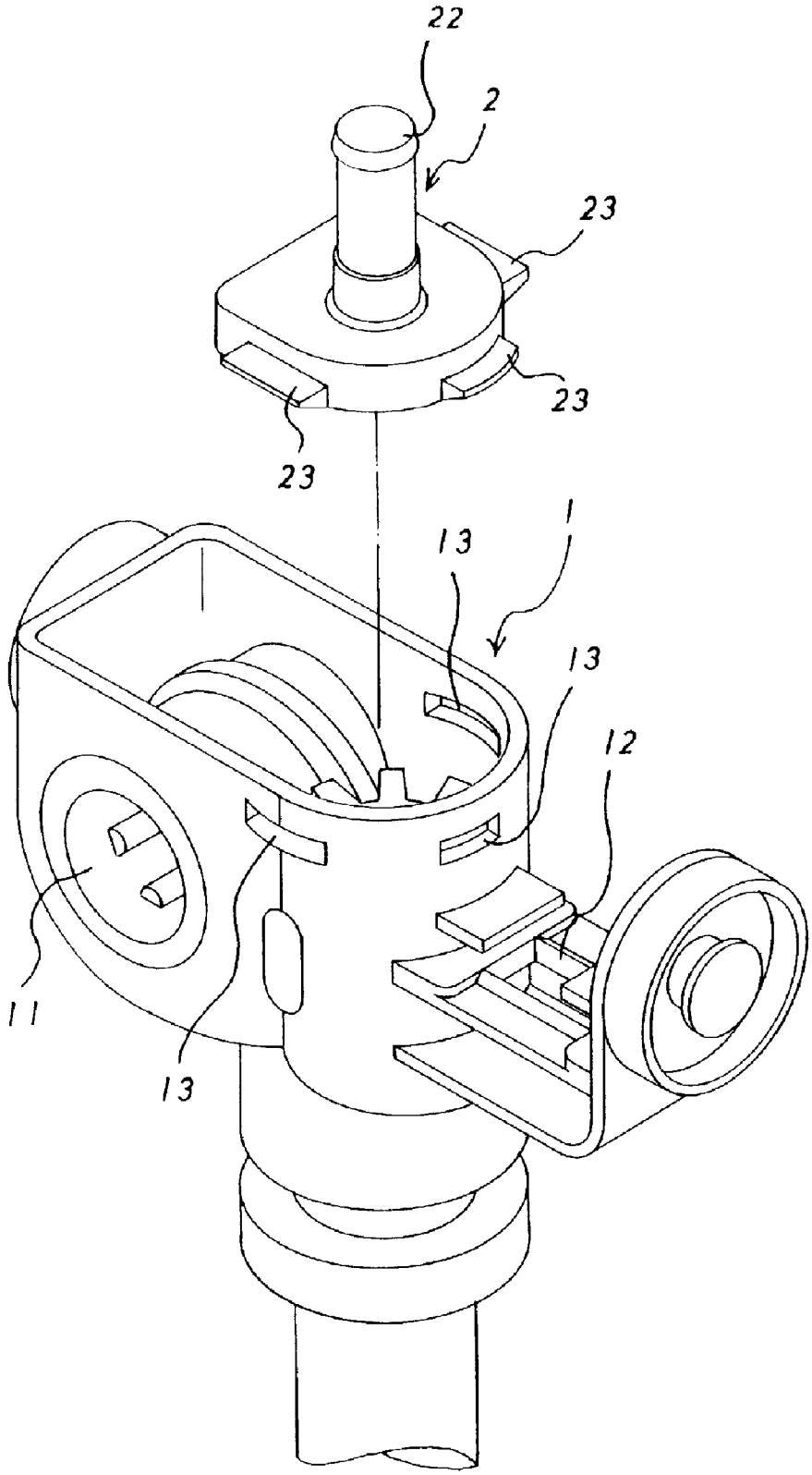
FIG. 7 is an exploded, perspective view of the movable seat connected to the connecting post of another embodiment.
Figure 8:
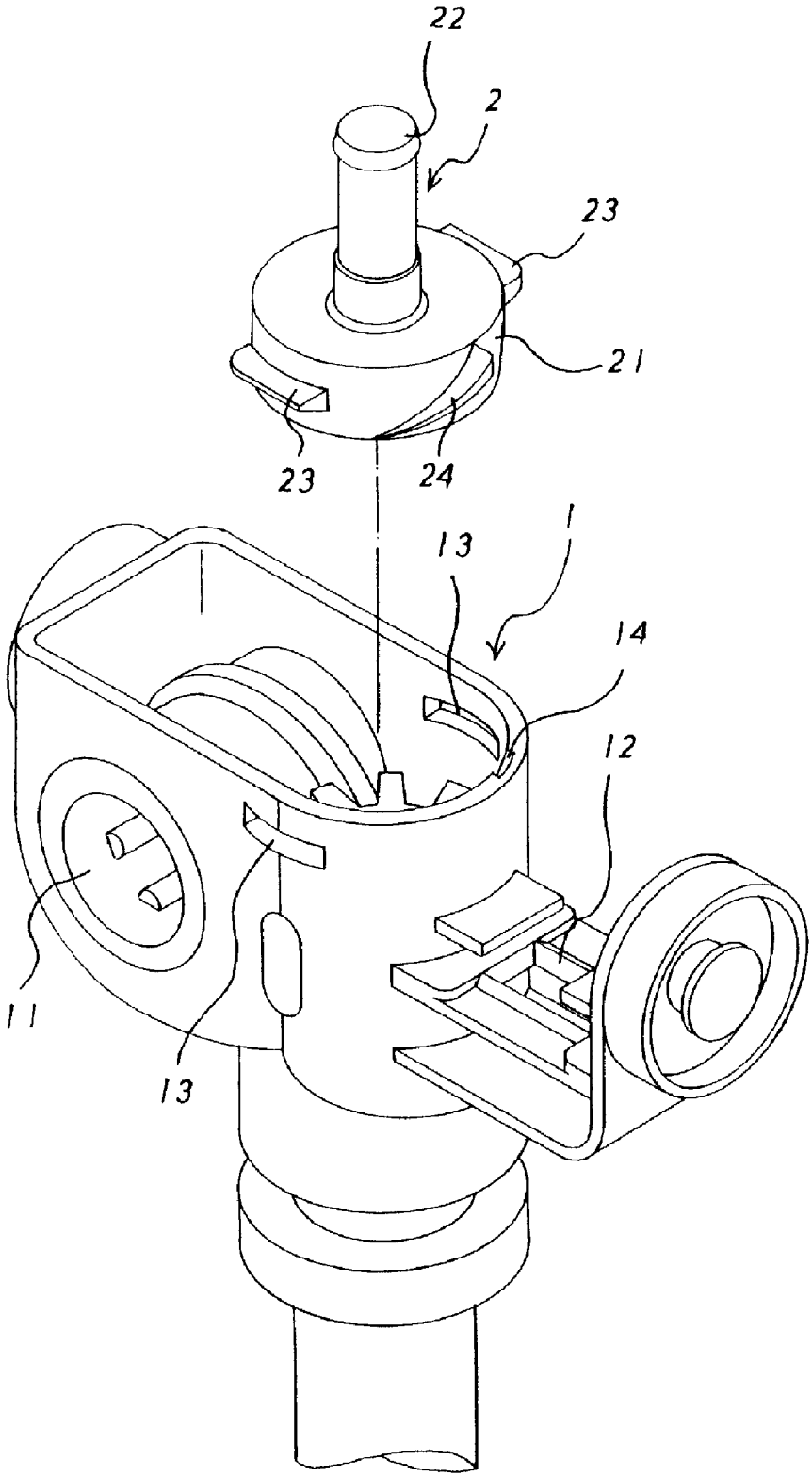
FIG. 8 is an exploded, perspective view of the movable seat connected to the connecting post of a further embodiment.
Figure 9:
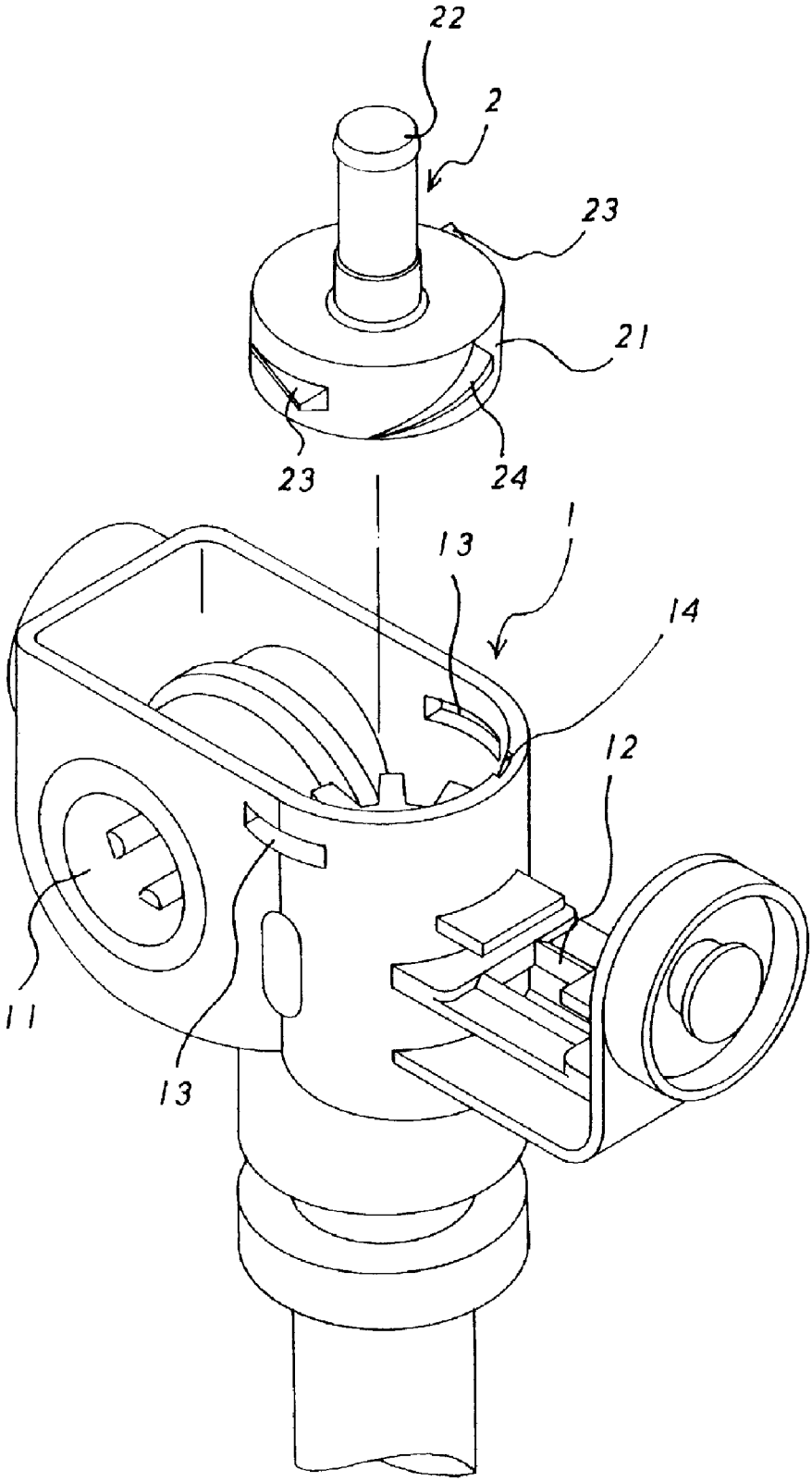
FIG. 9 is an exploded, perspective view of the movable seat connected to the connecting post of a still further embodiment.

A plurality of locking hooks 23 of the connecting post 2 (as shown in FIG. 7) is locked in threaded section 24 is protruded out of the base 21 of the connecting post 2 (as shown in FIG. 8), such that the movable seat 1 can be connected to the connecting post 2 stably. A threaded groove 14 is defined in the movable seat 1 and is located correspondingly to the threaded section 24, and engaging of the threaded section 24 with the threaded groove 14 enables the locking hook 23 to lock in the hook hole 13 easily. In addition, the locking hook 23 can be inclined along the threaded direction (as shown in FIG. 9). Thus, the locking hook 23 can also be locked in the hook hole 13 easily.

While various embodiments in accordance with the present invention have been shown and described, it should be clear to those skilled in the art that further embodiments may be made without departing from the scope of the present invention.

What is claimed is:

1. A vertical curtain comprising:

an upper rail;

vertical curtain blades;

a plurality of movable seats disposed in the upper rail, with one of the vertical curtain blades suspended from each movable seat;

a turning seat disposed in each movable seat;

a turning rod inserted in the turning seat of each movable seat, wherein one side of each movable seat is defined with an open slot, and wherein a hook hole is formed in a side of a top end of each movable seat;

a pivoting pole protrudes out of a base of a connecting post received in the top end of each movable seat, with a locking hook located correspondingly to the hook hole disposed on a side of the base;

a plurality of distance pieces, each distance piece engageable in the open slot of a respective movable seat and movable in the upper rail; and a scissor type distance piece connectable to the connecting post of each movable seat;

by such arrangements, the open slot of each movable seat can be connected to the distance piece and the connecting post of each movable seat can be connected to the scissor type distance piece to allow assembly of the vertical curtain blades according to requirements.

2. The vertical curtain as claimed in claim 1, wherein the connecting post is disposed with a plurality of said locking hooks.

3. The vertical curtain as claimed in claim 1, wherein a threaded section is protruded out of the base of the connecting post, and wherein a threaded groove is defined in an open end of each movable seat and is located correspondingly to the threaded section.

4. The vertical curtain as claimed in claim 1 or 2 or 3, wherein the locking hook is inclined.

* * * * *